US010914138B2

(12) United States Patent
Tubel et al.

(10) Patent No.: US 10,914,138 B2
(45) Date of Patent: Feb. 9, 2021

(54) DOWNHOLE POWER GENERATOR AND PRESSURE PULSER COMMUNICATIONS MODULE ON A SIDE POCKET

(71) Applicant: Tubel Energy LLC, The Woodlands, TX (US)

(72) Inventors: Paulo Tubel, The Woodlands, TX (US); Clark Bergeron, The Woodlands, TX (US); Forest Dickson, Spring, TX (US)

(73) Assignee: Tubel LLC, The Woodlands, TX (US)

( * ) Notice: Subject to any disclaimer, the term of this patent is extended or adjusted under 35 U.S.C. 154(b) by 234 days.

(21) Appl. No.: 15/600,363

(22) Filed: May 19, 2017

(65) Prior Publication Data

US 2017/0335679 A1 Nov. 23, 2017

Related U.S. Application Data

(60) Provisional application No. 62/339,617, filed on May 20, 2016.

(51) Int. Cl.

| | |
|---|---|
| ***E21B 41/00*** | (2006.01) |
| ***E21B 47/14*** | (2006.01) |
| ***E21B 47/13*** | (2012.01) |

(52) U.S. Cl.

CPC ..... *E21B 41/0085* (2013.01); *E21B 47/13* (2020.05); *E21B 47/14* (2013.01)

(58) Field of Classification Search

CPC ..... E21B 41/0085; E21B 47/14; E21B 47/18

See application file for complete search history.

(56) References Cited

U.S. PATENT DOCUMENTS

| | | | | |
|---|---|---|---|---|
| 4,015,234 A * | 3/1977 | Krebs | E21B 41/0085 | 367/81 |
| 5,732,776 A * | 3/1998 | Tubel | E21B 34/066 | 166/250.15 |
| 5,839,508 A * | 11/1998 | Tubel | E21B 41/0085 | 166/65.1 |
| 6,100,696 A * | 8/2000 | Sinclair | G01V 3/28 | 324/339 |
| 6,851,481 B2 * | 2/2005 | Vinegar | E21B 17/003 | 166/374 |
| 7,190,084 B2 * | 3/2007 | Hall | E21B 41/0085 | 290/1 R |
| 9,823,373 B2 * | 11/2017 | Skinner | G01V 1/40 | |

(Continued)

OTHER PUBLICATIONS https://www.glossary.oilfield.slb.com/en/Terms/s/side_pocket_mandrel.aspx.

https://www.bracetool.com/definition/416/downhole-tools-oilfield.

*Primary Examiner* — Robert E Fuller

(74) *Attorney, Agent, or Firm* — Maze IP Law, P.C.

(57) ABSTRACT

A downhole communications system comprises a power generator disposed proximate a predetermined portion of a side pocket mandrel in such a way as to not impede fluid flow within a wellbore into which the side pocket mandrel is disposed and a wireless communications transmitter operatively in communication with the power generator. Placed at least partially within a side pocket mandrel, the system allows fluid flowing proximate the side pocket mandrel to engage the power generator to create electric energy which may be used to power the wireless communications transmitter and allow data interchange between the wireless communications transmitter and a predetermined well device.

20 Claims, 2 Drawing Sheets

(56) References Cited

U.S. PATENT DOCUMENTS

| | | | | |
|---|---|---|---|---|
| 2007/0194948 | A1* | 8/2007 | Hall | E21B 17/003 340/854.8 |
| 2008/0047753 | A1* | 2/2008 | Hall | E21B 41/0085 175/57 |
| 2016/0245078 | A1* | 8/2016 | Mahmoud | E21B 47/18 |
| 2016/0341013 | A1* | 11/2016 | Hall | E21B 41/0085 |

* cited by examiner

DOWNHOLE POWER GENERATOR AND PRESSURE PULSER COMMUNICATIONS MODULE ON A SIDE POCKET

RELATION TO PRIOR APPLICATIONS

This application claims priority through U.S. Provisional Application 62/339,617 titled "Downhole Power Generator And Pressure Pulser Communications Module On A Side Pocket Mandrel," filed May 20, 2016.

BACKGROUND

One of the major requirements for hydrocarbon production is to obtain data from inside the well in real time. The ability to send information and commands in the well is also very important for the industry to optimize hydrocarbon production and for well integrity evaluation.

Wireless communications have been attempted inside wells with limited success. The use of batteries has limited the operating temperature of the communications system and also limited the life of the system as well the amount of data that could be transmitted to the surface. The elimination of the batteries as the primary source of power inside a well is one of the most important development for the acceptance of wireless communications in wells.

Downhole power generation has also been attempted with little success. The main objection is the placement of the generator in the flow stream path in the well. The generator can fail, leading to a build-up of debris which can decrease production. The power generator in the flow stream can prevent workover tools from being deployed below the generator through the tubing.

FIGURES

These and other features, aspects, and advantages of the system will become better understood with regard to the follow description, appended claims, and accompanying drawings where:

BRIEF DESCRIPTION OF EMBODIMENTS

Figure 1:
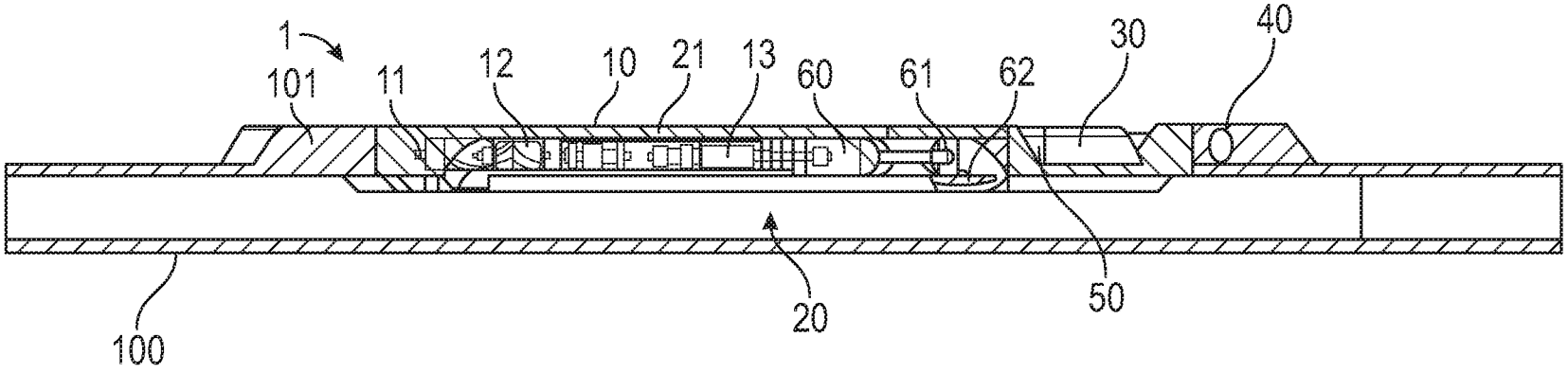
FIG. 1 is a cutaway view in partial perspective illustrating a side pocket mandrel and an exemplary system disposed within a side pocket of the side pocket mandrel.
Figure 2:
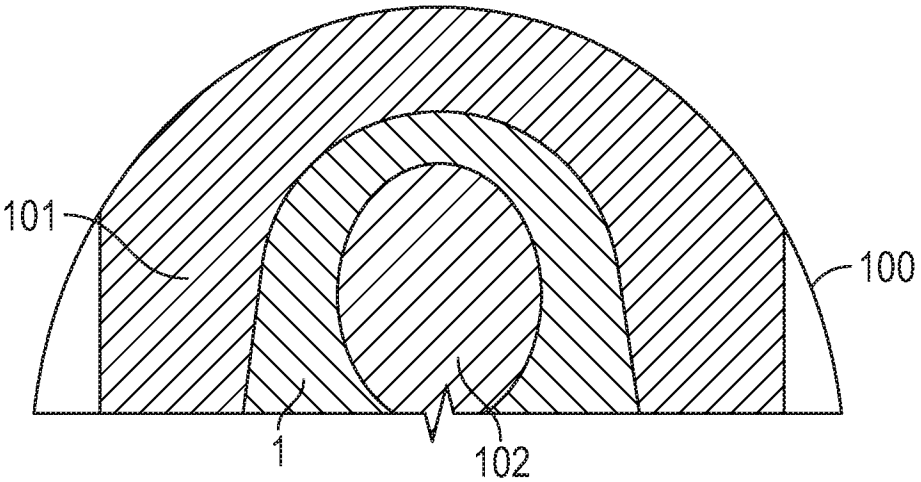
FIG. 2 is cutaway view in partial perspective illustrating a down-tool view showing a fluid flow conduit.

Referring now to FIG. 1, system 1 comprises power generator 10, wireless communications transmitter 20, and controller 30. System 1 is configured and sized to be placed inside side pocket 101 of side pocket mandrel 100, which is a parallel pipe to production tubing and normally machined as part of production tubing, in such a way as to not reduce the production path in a well. Side pocket mandrel 100 typically has first opening 102 (FIG. 3) at one end and second opening 103 (FIG. 3) at an opposite end to allow connecting side pocket mandrel 100 to main production pipe 200 (FIG. 4).

Wireless communications transmitter 20 comprises a transmitter (not specifically called out in the figures), one or more downhole sensors 40 and associated electronics such as, but not limited to, controller 30. In embodiments, the transmitter comprises a transceiver for bidirectional data communications.

In an embodiment, wireless communications transmitter 20 includes pressure pulser 21, which can be used for downhole-to-surface communications and which may comprise one or more pulser valves 60, where wireless communications transmitter 20 typically generates acoustic waves, electromagnetic waves, or the like, or a combination thereof which are useful for data communication. Electromagnetic waves can be generated to transmit the energy through the production pipe such as pipe 200 (FIG. 4) or a geological formation.

In another embodiment, generator 50, which may be an acoustic generator, can be present, either with or in place of pressure pulser 21, and used to provide acoustic energy as digital bits that travel to the surface using fluid, production tubing, or the like, or a combination thereof as the medium of communications for the acoustic waves.

Figure 3:
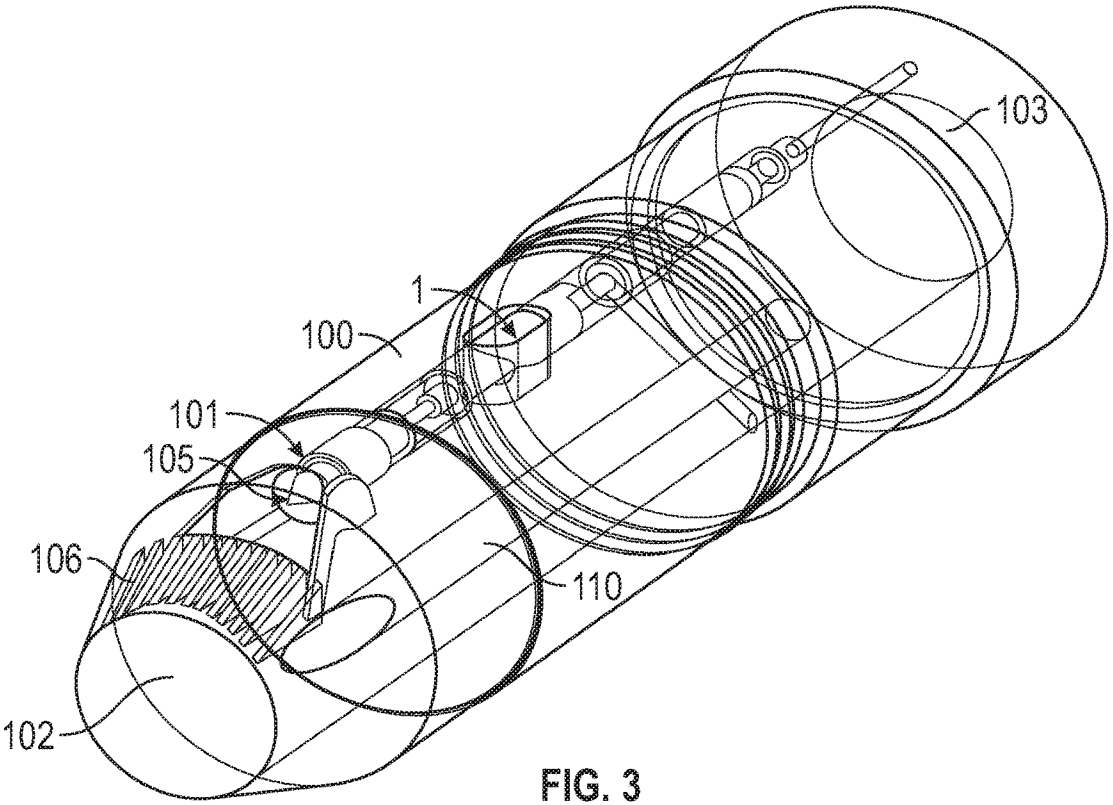
FIG. 3 is a partial cutaway view in partial perspective of an exemplary system.
Figure 4:
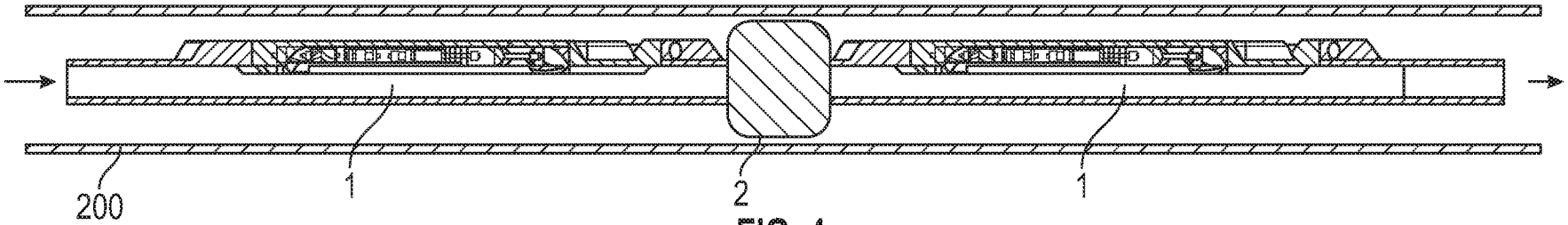
FIG. 4 is a block view of exemplary systems in situ.

Referring now to FIG. 3, in certain embodiments, pressure compensation tube 110 may be present to equalize the pressure in system 1 and power generator 10 may be in at least partially immersed in oil for proper operation. In addition, diverter 106, which may comprise a screen or the like, may be present at a fluid entry of conduit 105 to help with getting fluid flowing into side pocket 101.

In the operation of exemplary embodiments, referring generally to FIGS. 1 and 4, system 1 can harvest a small portion of the fluid flowing in a well to the surface to generate power. As such, it will not fully impede the fluid flow but, instead, as it enters side pocket 101, a portion of the fluid flow passes one or more rotatable impellers 11 (FIG. 1) attached to one or more stators 12 (FIG. 1) that are attached to power generator 10 (FIG. 1). Typically, the higher pressure required to push fluid through the smaller opening of side pocket mandrel 101 requires a change in the delta pressure; otherwise, the fluid will take the path of least resistance which is the larger production tubing.

In an embodiment, power generator 10 comprises one or more 3 phase modules, each with associated magnets and coils which, as will be familiar to those of ordinary skill in electronic arts, will generate harvestable electricity as rotating magnets interact with the coils.

In a further embodiment, electrical power, including harvested electrical power, may be stored in one or more power stores 13 such as rechargeable batteries, capacitors including super capacitors, or the like, or a combination thereof.

In most embodiments, multiple power generators 10 can be placed in single side pocket mandrel 100. The harvested and/or stored energy may then be used to power sensors 40 which may be located at or near side pocket mandrel 100 as well as communication module 20.

In embodiments, one or more valves 60, which may be pulser valves, may be present and actuated by controller 30. Valves 60 are preferably disposed within a fluid flow such as conduit 105 of side pocket mandrel 100. As actuated, valves 60 are typically operative to choke the flow stream going by or through side pocket 101, thereby creating a change in pressure that can be detected at the surface as digital communications.

If present, pulser filter 61 (FIG. 1) and deflector 62 (FIG. 1) operate to provide an amount of fluid to be taken from the main flow stream into side pocket mandrel 101 by mechanically modulating an opening in conduit 105 to allow fluids to flow from main bore 200 into side pocket 101. Pulser filter 61 provides an ability to prevent substances such as sand and the like from entering power generator 10 and possibly clogging impellers 11 which can cause the system to fail.

In addition, sensors 40 and flow control tools 2 can choke the flow or open/close the well fluid from entering the production tubing and can be attached to side pocket mandrel 100 to get power from system 1 and to communicate to the surface or get information from the surface.

System 1 can be placed anywhere in the wellbore to collect data and generate power. Electrically operated flow control tools 2 may be deployed as well that use the in situ generated power to operate properly and operatively be in communication with system 1 to receive power and/or other signaling from system 1.

The foregoing disclosure and description of the inventions are illustrative and explanatory. Various changes may be made without departing from the spirit of the invention. Therefore, the spirit and scope of the appended claims should not be limited to the description of the exemplary embodiments contained herein.

What is claimed is:

1. A downhole communications system, comprising:

a. a side pocket mandrel configured to be connected to a production tubing string in a wellbore, the side pocket mandrel comprising:

1. a first side pocket mandrel opening configured to be in fluid communication with the production tubing string;
2. a second side pocket mandrel opening disposed opposite the first side pocket mandrel opening and configured to be in fluid communication with the production tubing string;
3. a conduit in fluid communication with the first side pocket mandrel opening and the second side pocket mandrel opening; and
4. a side pocket disposed about a predetermined portion of the side pocket mandrel, the side pocket comprising:
   a. a side pocket conduit comprising a first side pocket opening disposed proximate the first side pocket mandrel opening and a second side pocket opening disposed proximate the second side pocket mandrel opening and in fluid communication with the first side pocket opening, the side pocket conduit in fluid communication with the conduit; and
   b. a fixed diverter disposed intermediate the first side pocket mandrel opening and the first side pocket opening, the fixed diverter configured to continuously divert a portion of the production fluid flowing within the wellbore through the first side pocket mandrel opening into the side pocket of the side pocket mandrel;

b. a power generator disposed within the side pocket conduit in such a way as to not fully impede flow of production fluid from within a wellbore into which the side pocket mandrel is disposed through the production tubing string to a surface location; and c. a wireless communications transmitter operatively in communication with the power generator, the wireless communications transmitter comprising a pressure pulser adapted to pulse fluid to communicate data between the side pocket mandrel and a surface location.

2. The downhole communications system of claim 1, further comprising a downhole sensor operatively in communication with the wireless communications transmitter.

3. The downhole communications system of claim 1, wherein the wireless communications transmitter comprises a wireless communications transceiver.

4. The downhole communications system of claim 1, wherein the wireless communications transmitter further comprises an acoustic wave generator operative to communicate data to a well location.

5. The downhole communications system of claim 1, wherein the wireless communications transmitter further comprises an electromagnetic wave generator operative to communicate data to a well location.

6. The downhole communications system of claim 5, wherein the electromagnetic wave generator is configured to communicate data within a production pipe or a geological formation.

7. The downhole communications system of claim 1, wherein the fixed diverter further comprises a screen.

8. The downhole communications system of claim 1, wherein the power generator comprises a fluid operated power generator.

9. The downhole communications system of claim 8, wherein the fluid operated power generator further comprises:

a. a fluid operable rotatable impeller; and b. an electromagnetic power source operatively connected to the fluid operable rotatable impeller.

10. The downhole communications system of claim 8, further comprising a rechargeable power store operatively in communication with the fluid operated power generator.

11. The downhole communications system of claim 10, wherein the rechargeable power store comprises a rechargeable battery or a capacitor.

12. The downhole communications system of claim 1, further comprising:

a. a controller operatively connected to the power generator; and b. the pressure pulser comprises a pulser valve disposed within the side pocket, the pressure pulser operatively in communication with the generator and the controller, the pulser valve operative to controllably cause a change in fluid pressure of fluid passing proximate the side pocket mandrel and operative to allow the fluid to enter and exit the side pocket of the side pocket mandrel.

13. A method of providing data communications within a well using a downhole communications system comprising a side pocket mandrel configured to be connected to a production tubing string in a wellbore, the side pocket mandrel comprising a first side pocket mandrel opening configured to be in fluid communication with the production tubing string, a second side pocket mandrel opening disposed opposite the first side pocket mandrel opening and configured to be in fluid communication with the production tubing string, a conduit in fluid communication with the first side pocket mandrel opening and the second side pocket mandrel opening, and a side pocket disposed about a predetermined portion of the side pocket mandrel where the side pocket comprises a side pocket conduit comprising a first side pocket opening and a second side pocket opening in fluid communication with the first side pocket opening and where the side pocket conduit is configured to be fluid communication with the production tubing string and a fixed diverter disposed intermediate the first side pocket mandrel opening and the first side pocket opening where the fixed diverter is configured to continuously divert production fluid flowing within the wellbore into the side pocket of the side pocket mandrel; a power generator disposed within the side pocket conduit in such a way as to not fully impede flow of production fluid from within a wellbore into which the side pocket mandrel is disposed through the production tubing string to a surface location; and a wireless communications transmitter comprising a pressure pulser adapted to pulse fluid to communicate data between the side pocket mandrel and a surface location where the wireless communications transmitter is operatively in communication with the power generator; the method comprising:

a. placing the downhole communications system at least partially within the side pocket;

b. allowing production fluid flowing from within the wellbore into which the side pocket mandrel is disposed through the production tubing string to a surface location to flow through the fixed diverter to continuously divert a portion of the production fluid flowing within the wellbore into the side pocket of the side pocket mandrel and engage the power generator to create electric energy;

c. powering the wireless communications transmitter using the power generator; and d. using pulsed fluid to interchange data between the wireless communications transmitter and a predetermined well device.

14. The method of providing data communications of claim 13, wherein the data interchange is bidirectional.

15. The method of providing data communications of claim 13, further comprising:

a. gathering sensor data from a sensor operatively connected to the power generator and the wireless communications transmitter; and b. interchanging the sensor data between the wireless communications transmitter and the predetermined well device.

16. The method of providing data communications of claim 13, the system further comprising a controller operatively connected to the power generator and operatively in communication with a flow control tool, the method further comprising using the controller to control the flow control tool to selectively choke or not choke a flow stream passing by proximate the side pocket mandrel, thereby creating a change in fluid pressure that can be detected at a surface location as digital communications.

17. The method of providing data communications of claim 16, wherein the flow control tool comprises a valve.

18. The method of providing data communications of claim 13, wherein the wireless communications transmitter further comprises an acoustic wave generator or an electromagnetic wave generator, the method further comprising using the wireless communications transmitter to controllably generate a set of acoustic or electromagnetic waves to effect data communication.

19. The method of providing data communications of claim 18, further comprising transmitting the set of electromagnetic waves through a production pipe or a geological formation.

20. The method of providing data communications of claim 13, wherein the wireless communications transmitter further comprises an acoustic generator, the method further comprising using the acoustic generator to provide acoustic energy as digital bits that travel to the surface.

* * * * *